US008814393B2

(12) United States Patent
Froelicher et al.

(10) Patent No.: US 8,814,393 B2
(45) Date of Patent: Aug. 26, 2014

(54) LIGHTING ASSEMBLY

(71) Applicant: General Electric Company, Schenectady, NY (US)

(72) Inventors: Stephen Bernard Froelicher, Shepherdsville, KY (US); Marc Eric Hottenroth, Crestwood, KY (US); Justin Tyler Brown, Louisville, KY (US)

(73) Assignee: General Electric Company, Schenectady, NY (US)

( * ) Notice: Subject to any disclaimer, the term of this patent is extended or adjusted under 35 U.S.C. 154(b) by 30 days.

(21) Appl. No.: 13/674,548

(22) Filed: Nov. 12, 2012

(65) Prior Publication Data

US 2014/0133157 A1 May 15, 2014

(51) Int. Cl.
*F21V 15/00* (2006.01)

(52) U.S. Cl.
USPC ..... 362/365

(58) Field of Classification Search
CPC ..... F21V 21/30; F21V 21/28; F21V 17/02; F21V 19/02; F21V 21/047–21/049; F21V 29/2206; F21V 29/2212; F21V 29/225; F21S 8/026; F21S 8/04; F21W 2101/06
USPC ..... 362/282, 285, 287, 364–365, 372, 362/547–549, 418, 419, 470
See application file for complete search history.

(56) References Cited

U.S. PATENT DOCUMENTS

| | | | | |
|---|---|---|---|---|
| 2,922,030 | A * | 1/1960 | Bobrick | 362/366 |
| 3,803,400 | A * | 4/1974 | Ozawa | 362/372 |
| 5,050,047 | A * | 9/1991 | Viner et al. | 362/552 |
| 5,183,330 | A * | 2/1993 | Rishel et al. | 362/372 |
| 6,850,001 | B2 * | 2/2005 | Takekuma | 313/501 |
| 6,949,730 | B2 * | 9/2005 | Lee et al. | 219/758 |
| 7,699,051 | B2 | 4/2010 | Gagas et al. | |

* cited by examiner

*Primary Examiner* — Julie Bannan
(74) *Attorney, Agent, or Firm* — Dority & Manning, P.A.

(57) ABSTRACT

A lighting assembly is provided. The lighting assembly includes a bracket and a frusto-spherical housing received by the bracket and mounted for rotation relative to the bracket. By rotating the frusto-spherical housing within the bracket, light emitted by the lighting assembly can be focused or directed in a selected direction.

18 Claims, 3 Drawing Sheets

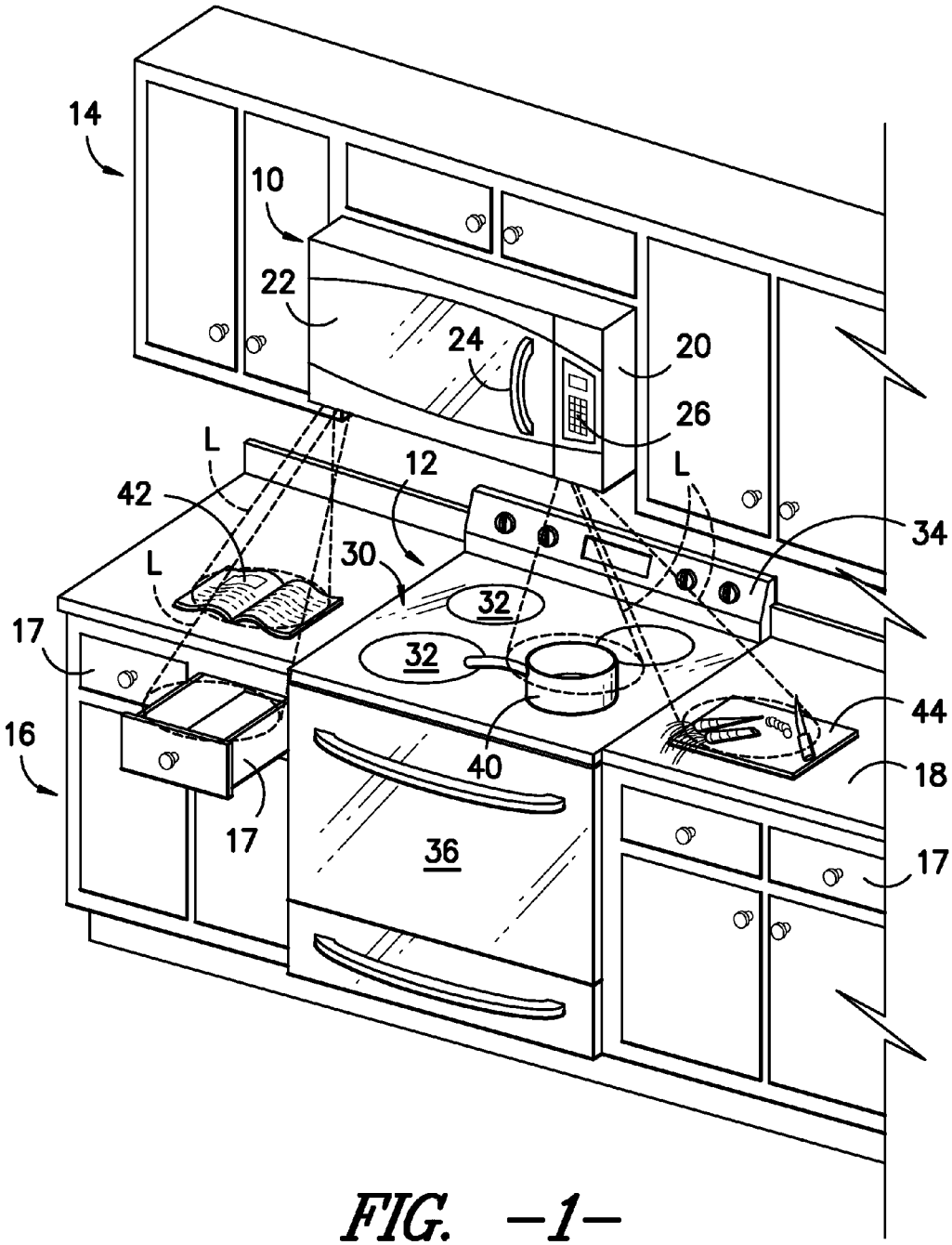
FIG. –1–

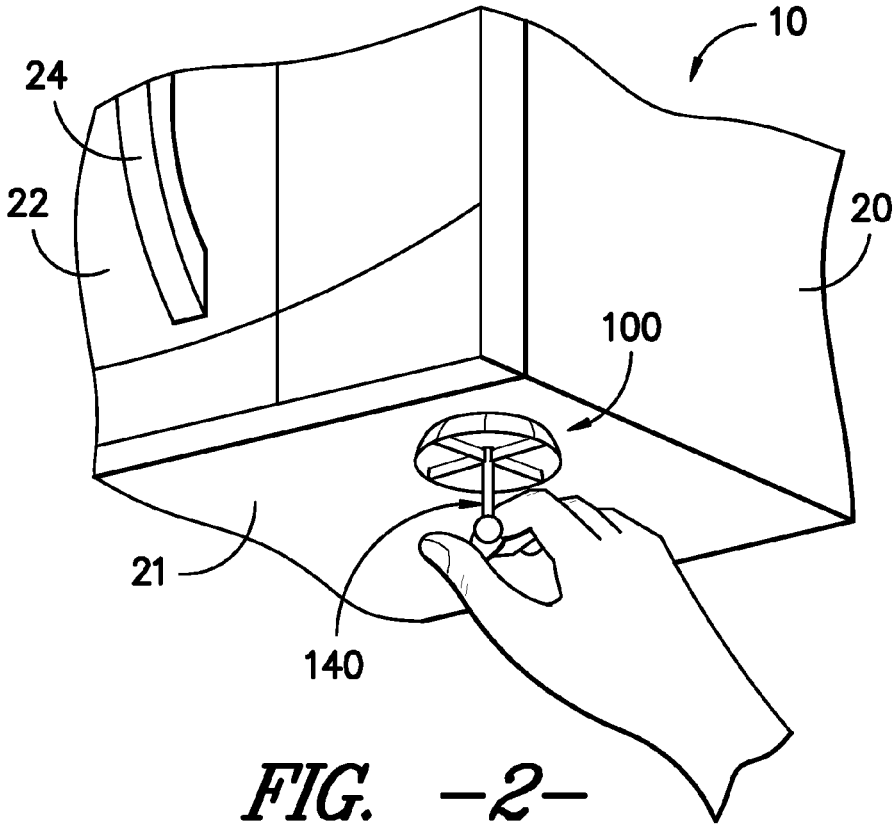
FIG. –2–
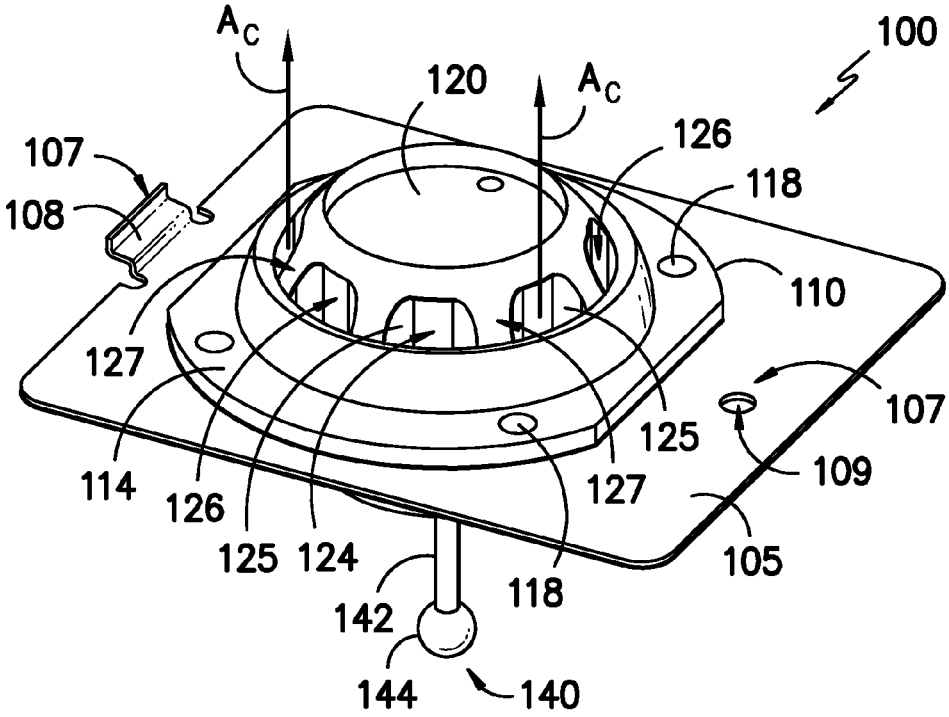
FIG. –3–

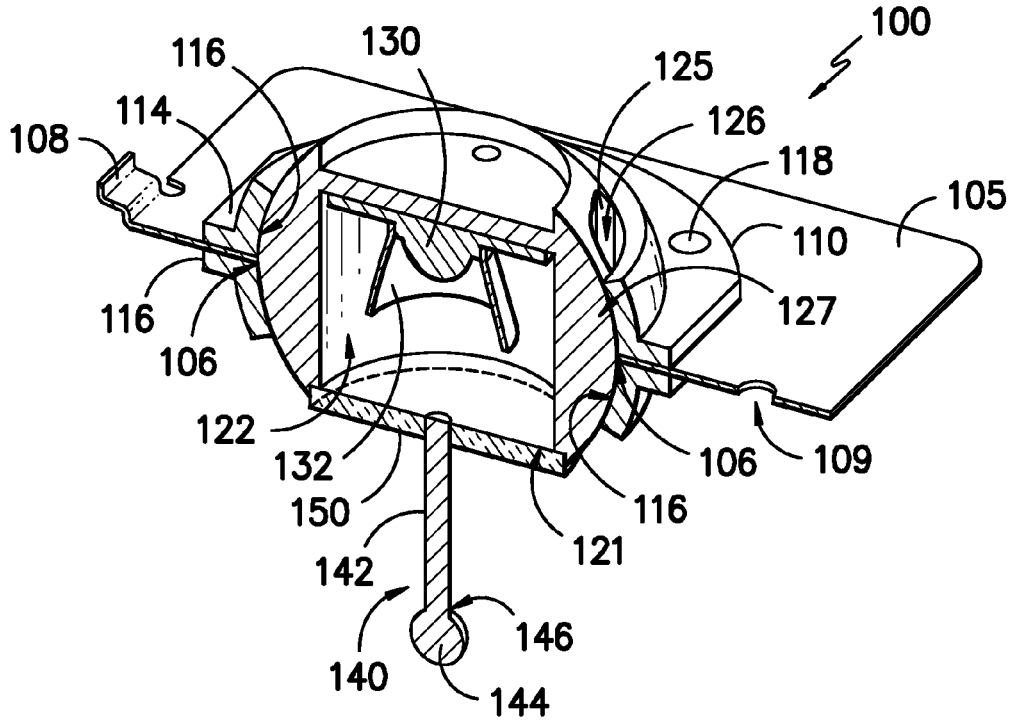
FIG. —4—
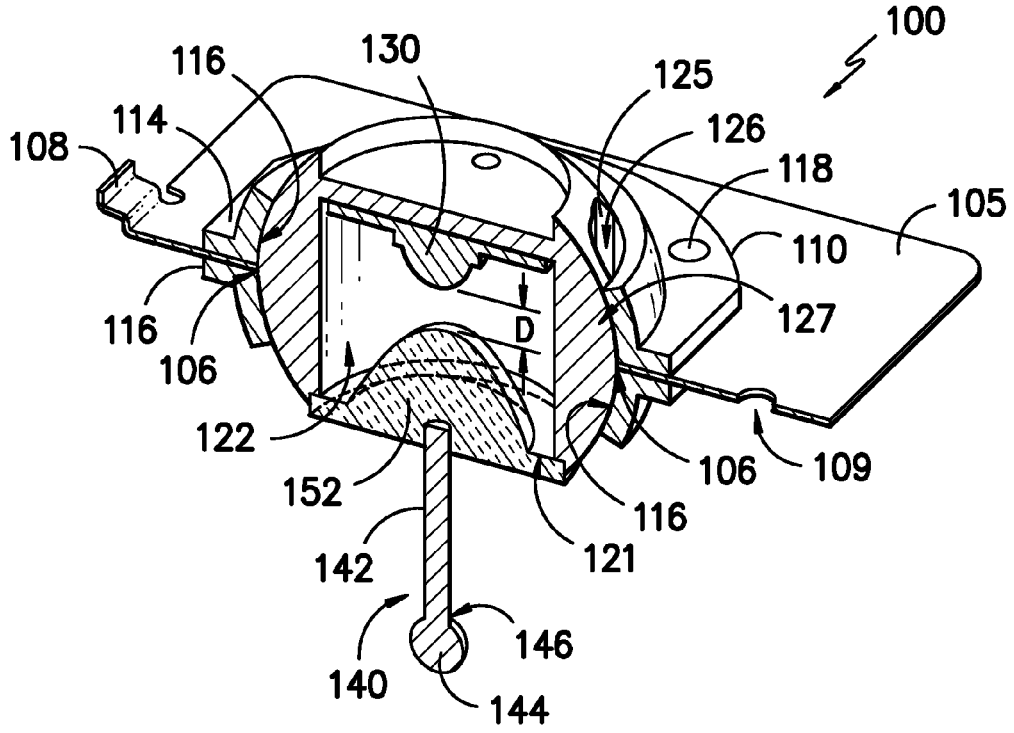
FIG. —5—

LIGHTING ASSEMBLY

FIELD OF THE INVENTION

The present subject matter relates generally to lighting assemblies, e.g., for appliances.

BACKGROUND OF THE INVENTION

Over-the-range microwave appliances and range hoods are generally mounted above a cooking surface of a range appliance. Over-the-range microwave appliances and range hoods can include lighting assemblies that direct light downwardly onto the range appliance's cooking surface or a nearby countertop space. Thus, such lighting assemblies can provide convenient light when required. However, such lighting assemblies generally include an incandescent bulb that can be dim or offer diffuse light. In addition, such lighting assemblies are generally fixed in place such that light from such lighting assemblies cannot be easily focused where needed.

Accordingly, a lighting assembly with features for facilitating focusing of light from the lighting assembly would be useful. In addition, a lighting assembly with features for facilitating selective directing of light from the lighting assembly to various locations would be useful.

BRIEF DESCRIPTION OF THE INVENTION

The present subject matter provides a lighting assembly. The lighting assembly includes a bracket and a frusto-spherical housing received by the bracket and mounted for rotation relative to the bracket. By rotating the frusto-spherical housing within the bracket, light emitted by the lighting assembly can be focused or directed in a selected direction. Additional aspects and advantages of the invention will be set forth in part in the following description, or may be apparent from the description, or may be learned through practice of the invention.

In a first exemplary embodiment, a lighting assembly is provided. The lighting assembly includes a bracket that defines an opening. A frusto-spherical housing is received within the opening of the bracket. The frusto-spherical housing is mounted for rotation relative to the bracket. The frusto-spherical housing defines a chamber and an opening that permits access to the chamber of the frusto-spherical housing. A light source is mounted within the chamber of the housing and is directed towards the opening of the housing. An adjustment mechanism is mounted to the housing at the opening of the housing. The adjustment mechanism extends away from the housing.

In a second exemplary embodiment, an appliance is provided. The appliance includes a casing and a lighting assembly. The lighting assembly includes a mounting plate that is secured to the casing. The mounting bracket defines an aperture. A bracket is mounted to the mounting plate at the aperture of the mounting plate. A frusto-spherical housing is received within the aperture of the mounting plate and secured to the mounting plate with the bracket. The frusto-spherical housing is mounted for rotation relative to the bracket. The frusto-spherical housing defines a chamber and an opening that permits access to the chamber of the frusto-spherical housing. A light source is mounted within the chamber of the housing and directed towards the opening of the housing. An adjustment mechanism is mounted to the housing at the opening of the housing. The adjustment mechanism extends away from the housing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 provides a perspective view of a microwave appliance according to an exemplary embodiment of the present subject matter mounted to a kitchen cabinet above a range appliance. The microwave appliance includes a lighting assembly according to an exemplary embodiment of the present subject matter for directing light towards a countertop and a cooking surface of the range appliance.

FIG. 2 is a bottom, partial perspective view of the microwave appliance of FIG. 1 showing the lighting assembly mounted to a bottom surface of the microwave appliance.

FIG. 3 is a perspective view of the lighting assembly of FIG. 2 removed from the microwave appliance.

FIG. 4 provides a section view of the lighting assembly of FIG. 3.

FIG. 5 provides a section view of the lighting assembly of FIG. 3. In FIG. 5, the lighting assembly includes a lens for focusing light from the lighting assembly.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an exemplary embodiment of the present subject matter mounted to an upper set of kitchen cabinets 14 above a range appliance 12. Microwave appliance 10 shown in FIG. 1 is commonly referred to as an over-the-range microwave. However, in alternative exemplary embodiments, the present subject matter may be used in any other suitable appliance, microwave appliance, fixture, or assembly. For example, the present subject matter may be used in range vent hoods, refrigerator appliances, and/or oven appliances.

As discussed above, microwave appliance 10 is mounted to upper set of kitchen cabinets 14. Upper set of kitchen cabinets 14 is positioned above a base set of kitchen cabinets 16 that includes countertops 18 and drawers 17. Thus, microwave appliance 10 is positioned above base set of kitchen cabinets 16. Range appliance 12 is received within base set of kitchen cabinets 16 below microwave appliance 10. In particular, a cooking surface 30 of range appliance 12 is positioned below microwave appliance 10. Microwave appliance 10 can include features such as a vent fan (not shown) that can draw cooking vapors and/or smoke away from cooking surface 30 and out of the kitchen containing microwave and range appliances 10 and 12.

Microwave appliance 10 is configured for receipt of food items for cooking In particular, microwave appliance 10 includes a casing 20 and a door 22 that permits selective access to an interior of microwave appliance 10 and casing 20. Door 22 includes a handle 24 that a user can pull to open door in order to insert food items into microwave appliance 10. Microwave appliance 10 also includes controls 26 that permit a user to make selections for cooking of food items, e.g., a duration of a cooking cycle of microwave appliance 10 and/or a power setting for the cooking cycle of microwave appliance 10.

As discussed above, range appliance 12 includes cooking surface 30. Cooking surface 30 includes heated portions 32 that may be heated by heating elements (not shown), e.g., electrical resistive heating elements, gas burners, induction heating elements, and/or any other suitable heating element of combination of heating elements. Range appliance 12 also includes a door 36 that permits access to a heated compartment (not shown) of range appliance 12, e.g., for cooking or baking of food items therein. A control panel 34 of range appliance 12 can permit a user to make selections for cooking of food items, e.g., a duration of a cooking cycle of range appliance 12 and/or a power setting for the cooking cycle of range appliance 12.

As may be seen in FIG. 1, microwave appliance 10 also includes features for directing light (shown with lines L) towards cooking surface 30 of range appliance 12, drawers 17, and/or countertops 18. In particular, microwave appliance 10 includes a lighting assembly 100 (FIG. 2) for directing light L towards drawers 17, countertops 18, and cooking surface 30 of range appliance 12 as discussed in greater detail below.

FIG. 2 is a bottom, partial perspective view of microwave appliance 10 showing lighting assembly 100 of microwave appliance 10 mounted to a bottom surface 21 of microwave appliance 10. As may be seen in FIG. 2, lighting assembly 100 includes an adjustment mechanism 140. A user can utilize adjustment mechanism 140 to adjust the direction of light L shown in FIG. 1. Thus, as an example, the user may pull or push on adjustment mechanism 140 to redirect or adjust light L emitted from lighting assembly 100 from a pot 40 on cooking surface 30 to a cutting board 44 on countertop 18 or from a cookbook 42 on countertop 18 to a drawer 17. Thus, light L emitted from lighting assembly 100 may be directed or focused onto items as needed. Such adjustment can provide a user with a suitable amount of light L where needed on cooking surface 30, countertop 18, drawer 17, and/or other suitable area or object.

FIG. 3 is a perspective view of lighting assembly 100 removed from microwave appliance 10. FIG. 4 provides a section view of the lighting assembly of FIG. 3. Lighting assembly 100 includes a mounting plate 105. Mounting plate 105 may be secured to bottom surface 21 of microwave appliance 10 in order to mount lighting assembly 100 to microwave appliance 10. Mounting plate 105 includes attachment mechanisms 107 that permit selective mounting of lighting assembly 100 to microwave appliance 10. For example, hook 108 may be secured to bottom surface 21 of microwave appliance 10 and a fastener (not shown), e.g., a screw, bolt, or pin, may be inserted through a hole 109 defined by mounting plate 105 into microwave appliance 10.

Mounting plate 105 also defines an aperture 106. A bracket 110 is secured to mounting plate 105 at aperture 106. Bracket 110 includes an upper portion 114 and a lower portion 116 that are secured together, e.g., with fasteners 118 such as bolts, screws, pins, or any other suitable fasteners. When lighting assembly 100 is mounted to bottom surface 30 of microwave appliance 10, upper portion 114 of bracket 110 may be positioned within microwave appliance 10, and lower portion 116 of bracket 110 may be disposed about on bottom surface 21 of microwave appliance 10.

Bracket 110 also defines a cavity 112. A frusto-spherical housing 120 is received within cavity 112 of bracket 110. Frusto-spherical housing 120 is also positioned within aperture 106 of mounting plate 105 such that frusto-spherical housing 120 extends through mounting plate 105. Bracket 110 mounts frusto-spherical housing 120 to mounting plate 105 such that frusto-spherical housing 120 can rotate within cavity 112 of bracket 110 relative to bracket 110 and/or mounting plate 105. In particular, frusto-spherical housing 120 is rotatably mounted within cavity 112 of bracket 110 such that frusto-spherical housing 120 can rotate about a plurality of axis within cavity 112 of bracket 110. For example, frusto-spherical housing 120 can be mounted for omni-directional rotation within cavity 112 of bracket 110.

Frusto-spherical housing 120 defines a chamber 122 and an opening 121 that permits access to chamber 122 of housing 120. A light source 130 is mounted within chamber 122 and configured for directing light towards opening 121. Light source 130 may be a light emitting diode, an incandescent bulb, a fluorescent bulb, or any other suitable light source or combination of light sources. A reflector 132 is also mounted within chamber 122 and reflects light emitted from light source 130 towards opening 121.

A cover 150 is mounted to frusto-spherical housing 120 at opening 121. Cover 150 is constructed of a transparent or translucent material such as glass, plastic, or any other suitable material that permits light emitted from light source 130 to pass therethrough. Adjustment mechanism 140 is mounted to cover 150 in the exemplary embodiment shown in FIG. 4. However, in alternative exemplary embodiments, adjustment mechanism 140 may be mounted to frusto-spherical housing 120 or any other suitable component of lighting assembly 100.

Adjustment mechanism includes a stem 142 that is mounted to cover 150 and extends away from cover 150 to a distal end 146. A handle 144 is mounted to stem 152 at distal end 156 of stem 152. Handle 144 and/or stem 152 may be constructed of a material with a relatively low heat capacity and/or a relatively low thermal conductivity. For example, handle 144 and/or stem 152 may be constructed of a material with a heat capacity less than about sixteen-hundred joules per kilogram-degree kelvin and a thermal conductivity less than about two-hundred and twenty milliwatts per meter-degree kelvin. In particular, handle 144 and/or stem 152 may be constructed of wood, open or closed cell cellular material such as polystyrene, or any other suitable material.

Lighting assembly 100 includes features for cooling lighting assembly 100 during operation of light source 130. For example, frusto-spherical housing 120 can become hot during operation of light source 130. Frusto-spherical housing 120 includes a plurality of fins 125 that extend away from an outer surface 124 of frusto-spherical housing 120. Each fin of plurality of fins 125 includes a distal portion 127 that is positioned away from outer surface 124 of frusto-spherical housing 120 and adjacent bracket 110, e.g., immediately adjacent or in contact with bracket 110. Plurality of fins 125 can act as a heat sink that dissipate heat from frusto-spherical housing 120 into surrounding air as will be understood by those skilled in the art.

Outer surface 124 of frusto-spherical housing 120 and bracket 110 also define a plurality of passages 126. Plurality of passages 126 permits a flow of cooling air $A_C$ to pass therethrough. Flow of cooling air $A_C$ can assist with cooling lighting assembly 100. For example, when flow of cooling air $A_C$ has a temperature that is less than outer surface 124 of frusto-spherical housing 120, heat transfer between outer surface 124 of frusto-spherical housing 120 and flow of cooling air $A_C$ can transfer thermal energy away from or out of frusto-spherical housing 120 as will be understood by those skilled in the art.

To further facilitate heat transfer away from or out of frusto-spherical housing 120, frusto-spherical housing 120 may be constructed of a material with a relatively high thermal conductivity. For example, frusto-spherical housing 120 may be constructed of a material with a thermal conductivity greater than about fifty watts per meter-degree kelvin. For example, frusto-spherical housing 120 may be constructed with a die-cast material such as a die-cast aluminum or aluminum-zinc alloy, or any other suitable material.

FIG. 5 provides a section view of lighting assembly 100. In FIG. 5, the lighting assembly 100 includes a lens 152 for focusing light emitted from light source 130. Lens 152 may be mounted to cover 150 or frusto-spherical housing 120. Lens 152 may be constructed of a transparent or translucent material such as glass or plastic (e.g., an amorphous plastic). Lens 152 is spaced apart or separated from light source 130 by a distance D. Lens 152 may be translatable relative to light source 130 such that distance D may be selectively adjusted in order to provide selective focus of light emitted by light source 130. Thus, when lens 152 is mounted to cover 150, cover 150 may slide or rotate within or relative to frusto-spherical housing 120 in order to adjust distance D. Such adjustment of D can narrow or broaden the focus of light emitted by light source 130 as will be understood by those skilled in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lighting assembly comprising:

a bracket that defines a cavity;

a frusto-spherical housing received within the cavity of said bracket, said frusto-spherical housing mounted for rotation relative to said bracket, said frusto-spherical housing defining a chamber and an opening that permits access to the chamber of said frusto-spherical housing, said frusto-spherical housing having an outer surface,the outer surface of said frusto-spherical housing and said bracket defining a plurality of passages that facilitate a flow of air therethrough;

a light source mounted within the chamber of said housing and directed towards the opening of said housing; and an adjustment mechanism mounted to said housing at the opening of said housing, said adjustment mechanism extending away from said housing.

2. The lighting assembly of claim 1, further comprising a cover mounted at the opening of said housing, said cover comprising a transparent or translucent material.

3. The lighting assembly of claim 2, wherein said adjustment mechanism is mounted to said cover.

4. The lighting assembly of claim 2, wherein said cover further comprises a lens.

5. The lighting assembly of claim 4, wherein a distance between said lens and said light source is selectively adjustable in order to focus light emitted from said light source.

6. The lighting assembly of claim 1, further comprising a conical reflector mounted within the chamber of said frusto-spherical housing adjacent said light source.

7. The lighting assembly of claim 1, wherein said frusto-spherical housing comprises a plurality of fins that extend outwardly from said frusto-spherical housing.

8. The lighting assembly of claim 7, wherein each fin of the plurality of fins has a distal portion that is positioned immediately adjacent said bracket.

9. The lighting assembly of claim 1, wherein said light source comprises a light emitting diode.

10. The lighting assembly of claim 1, wherein said adjustment mechanism comprises a stem that extends away from said frusto-spherical housing to a distal end, and a handle mounted on the distal end of the stem.

11. The lighting assembly of claim 10, wherein the handle of said adjustment mechanism comprises a material with a heat capacity less than about sixteen hundred joules per kilogram-degree kelvin and a thermal conductivity less than about two-hundred and twenty milliwatts per meter-degree kelvin.

12. The lighting assembly of claim 1, wherein said frusto-spherical housing comprises a die cast material.

13. The lighting assembly of claim 12, wherein the die cast material comprises aluminum or an aluminum-zinc alloy.

14. An appliance comprising:

a casing; and a lighting assembly comprising:

a mounting plate secured to said casing, said mounting plate defining an aperture;

a bracket mounted to said mounting plate at the aperture of said mounting plate;

a frusto-spherical housing rotatably received within the aperture of said mounting plate and secured to said mounting plate with said bracket, said frusto-spherical housing defining a chamber and an opening that permits access to the chamber of said frusto-spherical housing, said frusto-spherical housing having an outer surface, the outer surface of said frusto-spherical housing and said bracket defining a plurality of passages that facilitate a flow of air therethrough;

a light source mounted within the chamber of said housing and directed towards the opening of said housing; and an adjustment mechanism mounted to said housing at the opening of said housing, said adjustment mechanism extending away from said housing.

15. The appliance of claim 14, further comprising a cover mounted at the opening of said housing, said cover comprising a transparent or translucent material.

16. The appliance of claim 14, wherein said frusto-spherical housing comprises a plurality of fins that extend outwardly from said frusto-spherical housing.

17. The appliance of claim 14, wherein said light source comprises a light emitting diode.

18. The appliance of claim 14, wherein said adjustment mechanism comprises a stem that extends away from said frusto-spherical housing to a distal end, and a handle mounted on the distal end of the stem.

* * * * *